US007090319B2

(12) United States Patent
Milligan et al.

(10) Patent No.: US 7,090,319 B2
(45) Date of Patent: Aug. 15, 2006

(54) GUIDE TAB AND SLIDE INCORPORATING THE SAME

(75) Inventors: Charles A. Milligan, Hacienda Heights, CA (US); Robert Bryson, Riverside, CA (US)

(73) Assignee: Accuride International, Inc., Sante Fe Springs, CA (US)

( * ) Notice: Subject to any disclaimer, the term of this patent is extended or adjusted under 35 U.S.C. 154(b) by 123 days.

(21) Appl. No.: 10/222,025

(22) Filed: Aug. 15, 2002

(65) Prior Publication Data

US 2003/0034720 A1 Feb. 20, 2003

Related U.S. Application Data

(60) Provisional application No. 60/313,276, filed on Aug. 17, 2001.

(51) Int. Cl.
*A47B 88/04* (2006.01)

(52) U.S. Cl. ..... 312/334.46; 312/334.44

(58) Field of Classification Search ..... 312/333, 312/334.8, 334.7, 334.1, 334.47, 334.46, 312/334.44, 330.1; 384/20, 21
See application file for complete search history.

(56) References Cited

U.S. PATENT DOCUMENTS

| | | | | |
|---|---|---|---|---|
| 3,650,578 | A | 3/1972 | Del Vecchio et al. | |
| 4,993,847 | A * | 2/1991 | Hobbs | 384/21 |
| 4,998,828 | A * | 3/1991 | Hobbs | 384/18 |
| 5,316,389 | A | 5/1994 | Hoffman | |
| 5,577,821 | A | 11/1996 | Chu | |
| 6,145,945 | A | 11/2000 | Parvin | |
| 6,450,600 | B1 * | 9/2002 | Chen et al. | 312/334.46 |
| 2002/0081887 | A1 * | 6/2002 | Judge et al. | 439/348 |

FOREIGN PATENT DOCUMENTS

EP 107525 * 5/1984

* cited by examiner

*Primary Examiner*—James O. Hansen
(74) *Attorney, Agent, or Firm*—Christie, Parker & Hale, LLP

(57) ABSTRACT

A guide tab and a multiple member slide incorporating such guide tab are provided. The guide tab is coupled to one slide member of the slide. When actuated, the guide tab activates a latch allowing another slide member of the slide to decouple from the slide.

31 Claims, 9 Drawing Sheets

GUIDE TAB AND SLIDE INCORPORATING THE SAME

CROSS-REFERENCE TO RELATED APPLICATION

This application claims the benefit of and is based on Provisional Application Ser. No. 60/313,276, filed on Aug. 17, 2001, the contents of which are fully incorporated herein by reference.

BACKGROUND OF THE INVENTION

The present invention relates to a guide tab for pushing a slide lock latch for disengaging a slide member from a slide or for engaging a slide member to a slide and to a slide incorporating the same.

Slides which are used to slidably couple drawers to a cabinet or desk consist of two or more members, a stationary member and at least one telescoping member. The stationary member is typically mounted in a cabinet or desk, while the telescoping member is connected to a drawer slidably coupling the cabinet or desk. Two slides are typically used to couple the drawer to the cabinet or desk, one on either side of the drawer.

A three member slide has an intermediate telescoping member slidably engaged by means of ball bearings fitted in bearing retainers with a stationary member and with a telescoping member to enable longer drawer extensions. In a two member slide, the telescoping member is coupled to the stationary member by means of ball bearings fitted in a bearing retainer. The ball bearings ride on bearing raceways formed on each slide member.

To allow for the drawer to easily disconnect from the cabinet or desk, the telescoping members of the slide are made so that they can easily disconnect from the slide. Typically, it is the telescoping member connected to the drawer that is made to easily disconnect from the slide. A lock latch is typically mounted on the telescoping member. The latch engages an end of the slide member coupled to the telescoping member. To disconnect the telescoping member from the slide, i.e., to disconnect the drawer from the cabinet or desk, the latch on each slide telescoping member on either side of the drawer is pushed in while the drawer is pulled open, releasing the telescoping member from the remaining member(s) of the slide. Similarly, the reconnect the telescoping member to the slide, the lock latches on both telescoping slide members must be pushed in to allow the telescoping members to slide within the appropriate members of the slides.

When a person pushes the latch with his/her finger to allow the telescoping member to reconnect to the slide, it is not uncommon for such person to get his/her finger pinched between a slide member and the lock latch. The present invention provides for a guide tab that allows for one to disconnect or reconnect to a telescoping slide member to a slide without pinching his/her finger.

SUMMARY OF THE INVENTION

A guide tab and a multiple member slide incorporating the same are provided. The guide to one slide member coupled to the slide. When actuated, the guide tab activates a latch allowing the slide member to decouple from the slide. In one exemplary embodiment the guide is coupled a first slide member of a slide. A second slide member is slidably coupled to the first slide member. A latch is coupled to the second slide member allowing the second slide member to couple and decoupled from the first slide member. When actuated, the guide tab activates the latch allowing the second slide member to decouple from the first slide member. The guide tab may extend beyond an end of the first slide member from which the first slide member extends.

In another exemplary embodiment, a cut-out is formed on a web of the first slide member. The cut-out extends to end of the web and the guide tab extends over the cut-out. When the second slide member is fully extended relative to the first slide member, at least a portion of the latch is positioned within the cutout formed on the web of the first slide member.

In a further exemplary embodiment, the guide tab extends from a guide block which has a web portion and two spaced apart leg portions extending transversely from the web portion. The guide tab extends between the two leg portions of the guide block The web portion of the guide block is accommodated in an opening formed the first slide member.

DETAILED DESCRIPTION

The inventive guide tab can be used with any multiple member slide as for example, a two member slide or a three member slide. With a multiple member slide the guide tab is coupled to a first slide member onto which reconnects or from which disconnects a second slide member. For descriptive purposes, the present invention is described in conjunction with a three member slide with the guide tab coupled to the intermediate member of the three member slide.

Figure 1:
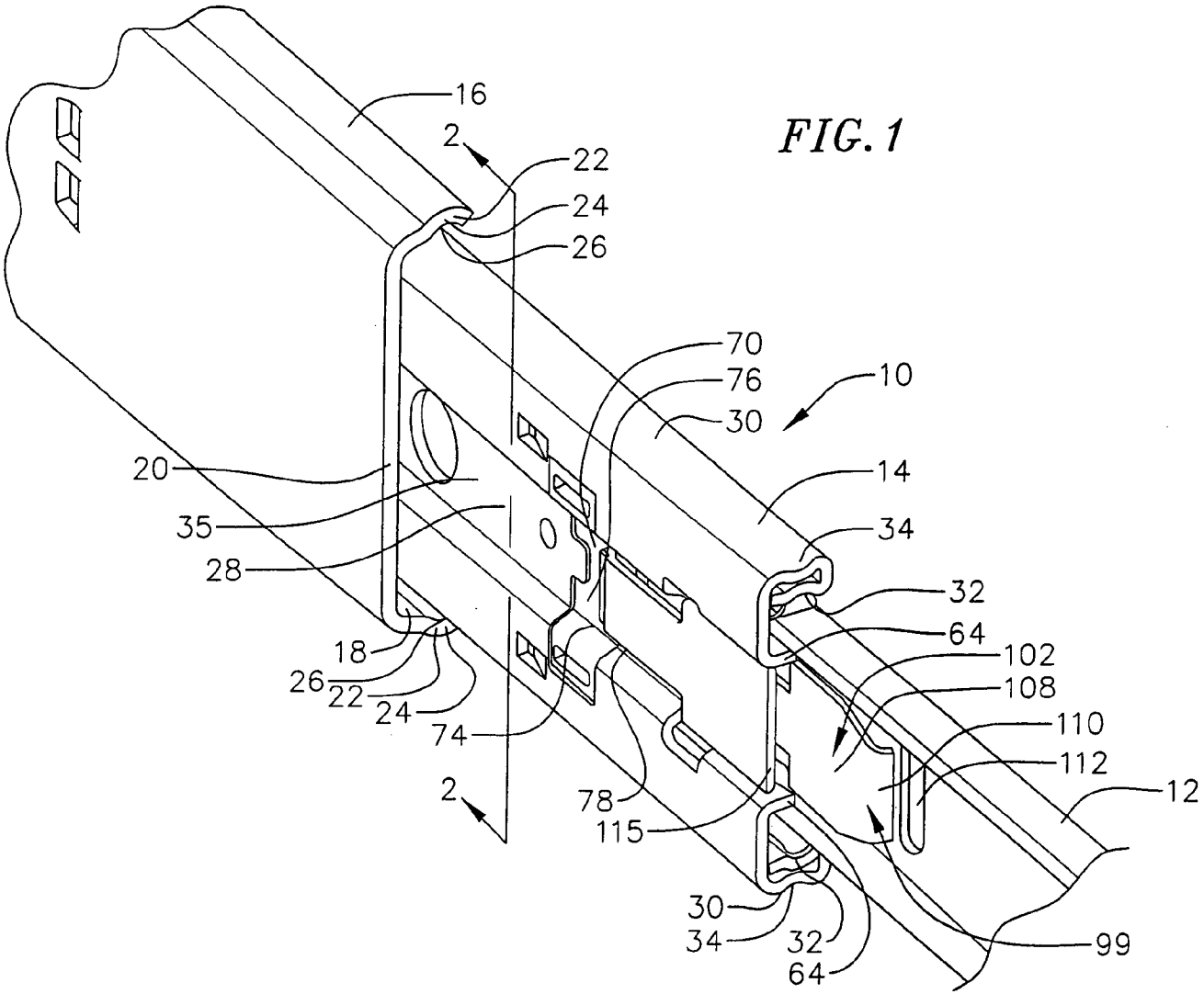
FIG. 1 is a perspective view of a slide incorporating an exemplary embodiment guide tab of the present invention.
Figure 2:
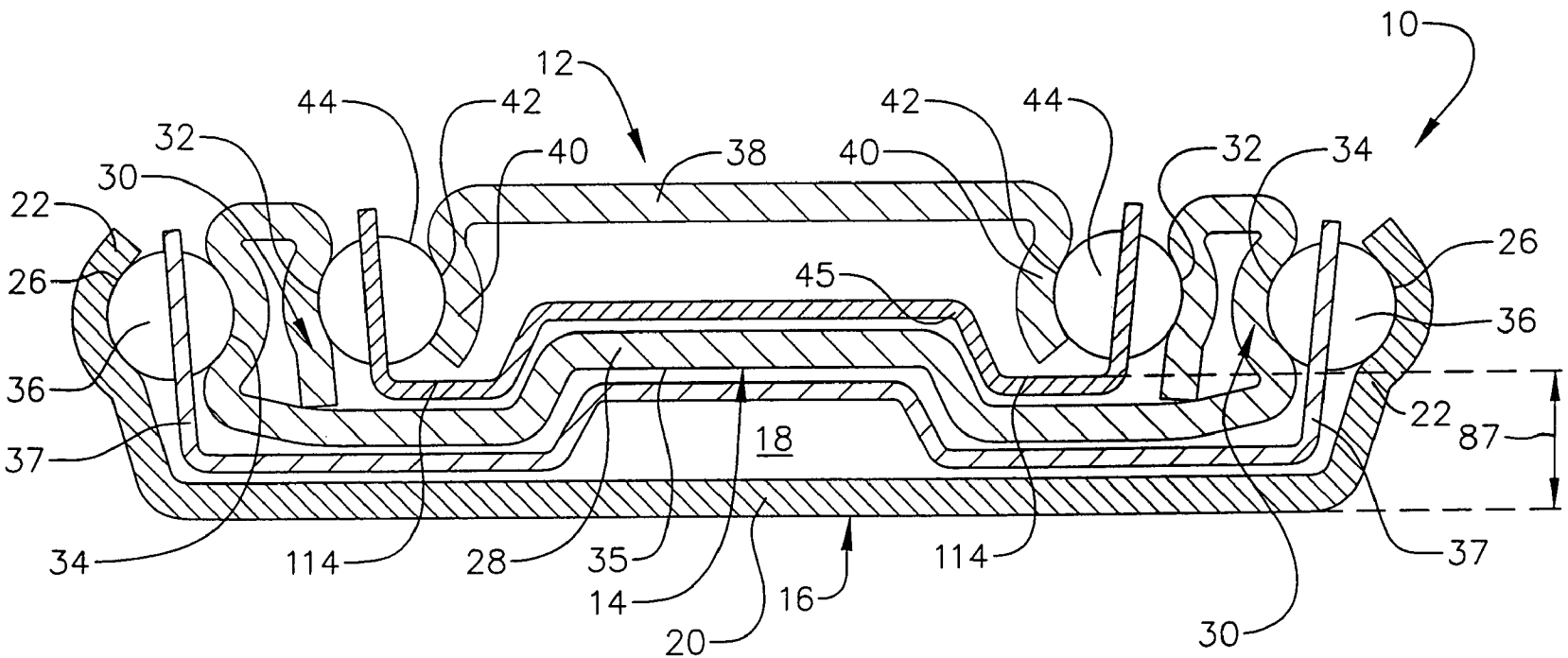
FIG. 2 is a cross-sectional view taken along arrow 2—2 of the slide shown in FIG. 1

A typical three member slide 10 comprises an inner telescoping member 12 slidably coupled to an intermediate telescoping member 14 which is slidably coupled to an outer stationary member 16 (FIGS. 1 and 2). The outer member is channel shaped in cross section, i.e., it defines a channel 18, having web 20 and two legs 22 extending transversely from opposite ends of the web. An inner bearing raceway 26 is defined on each leg 22. The intermediate slide member 14, also generally channel shaped in cross-section, is slidably coupled within the outer member 16.

In cross-section, the intermediate member also comprises a web 28 and two legs 30 extending from opposite ends of the web. Each of the legs defines an inner raceway 32 and an outer raceway 34. A central portion of the intermediate member web 28 may define a longitudinal depression 35. The intermediate member is slidably coupled within the outer member with their "channels" facing in the same direction. Ball bearings 36 are sandwiched between the inner bearing raceways 26 of the outer member and the outer bearing raceways 34 of the intermediate member. The ball bearings are typically coupled to an outer ball bearing retainer 37.

The inner member is also channel shaped in cross-section comprising a web 38 having two legs 40 extending from opposite ends of the web. A concavity is formed on the outer surface of each leg defining an outer bearing raceway 42. The inner member is slidably coupled to the intermediate member with the channel of the inner member facing the channel of the intermediate member. In other words, the legs of the inner member extend from the web 38 of the inner member toward the web 28 of the intermediate member. Ball bearings 44 are sandwiched between the outer bearing raceways 42 of the inner member and the inner bearing raceways 32 of the intermediate member. The ball bearing are typically coupled to an inner ball bearing retainer 45. Each slide member is typically formed from a single piece of material.

A lock latch mechanism is formed on the intermediate and inner slide members to allow the inner slide to disconnect from and reconnect to the intermediate slide member. An exemplary embodiment lock latch mechanism includes a lock latch 99 extending from the inner member and a cut out 60 formed at and end portion of the intermediate member web 28 which extends to the end 61 of the intermediate member from which the inner member extends. Two set of lance tabs are formed along the sides of the cut out. The first set of lance tabs comprises two tabs 62 located opposite each other and extending from opposite edges of the cut out toward the inner slide member. The second set comprises two lance tabs 64 located opposite each other and extending from opposite edges of the cut out and toward the inner slide member. The second set of lance tabs are located at the end 61 of the cut out at the end of the intermediate member and are spaced apart by a distance greater than the distance between the first set, i.e., the spacing 66 between the two second set tabs 64 is greater than the spacing 68 between the two first set tabs 62. The first set of lance tabs is furthest from the end 61 of the intermediate member from which the inner member extends.

Figure 3B:
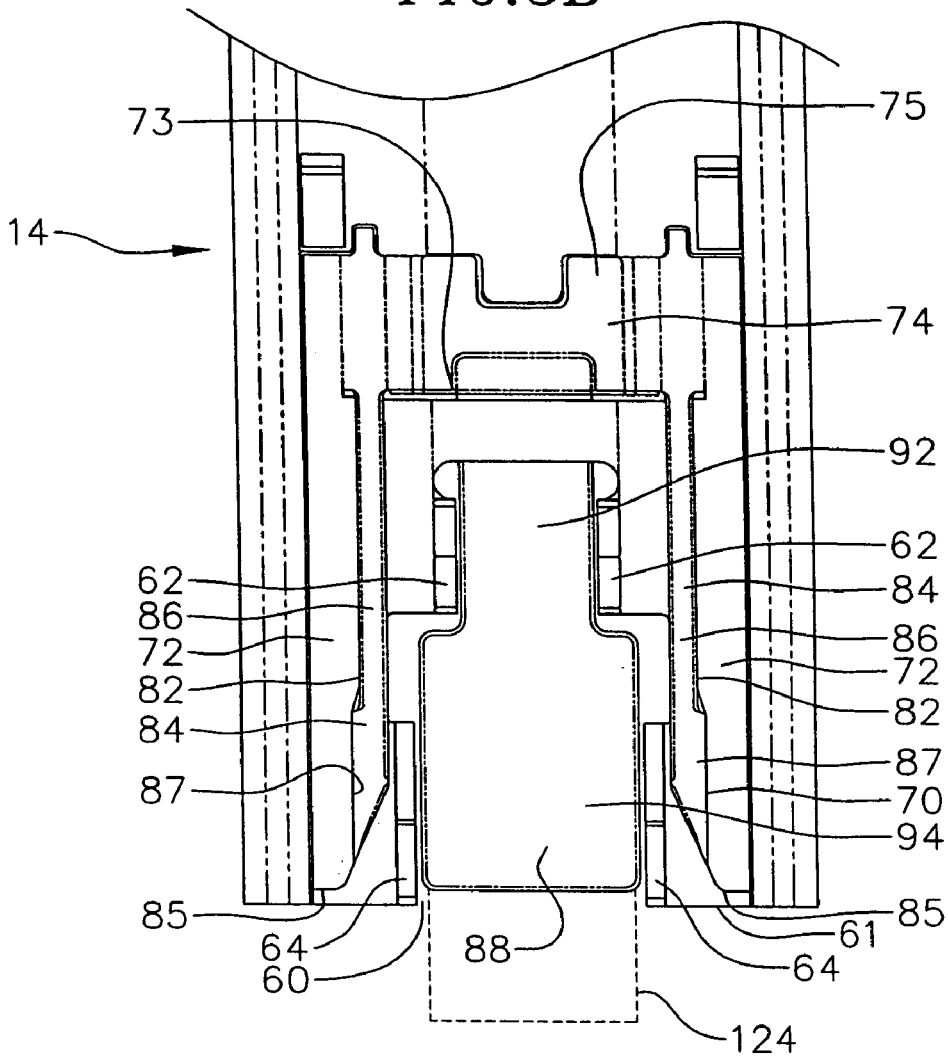
FIGS. 3A and 3B are an end view and a bottom view, respectively of the intermediate member incorporating the exemplary embodiment guide tab.
Figure 3A:
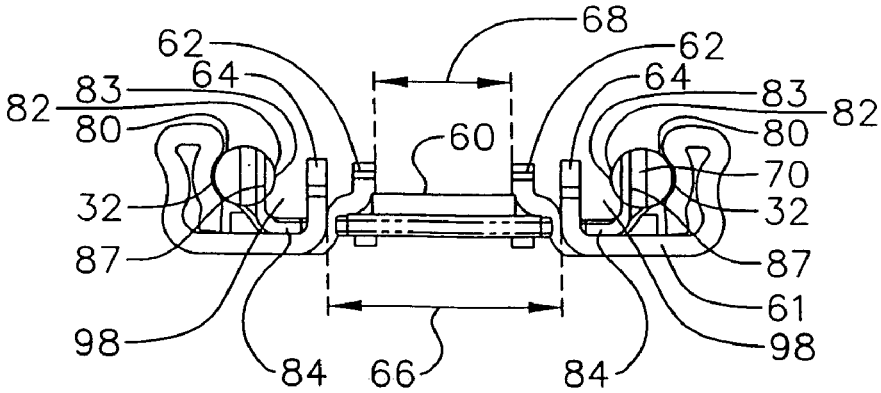
Figure 4A:
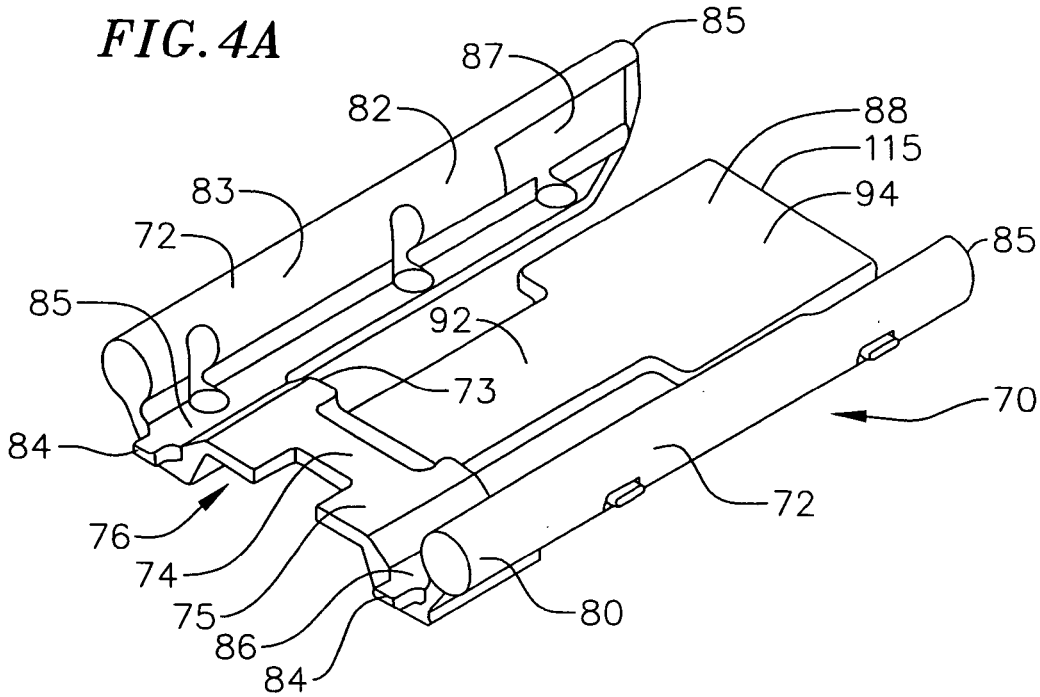
FIGS. 4A, 4B, 4C and 4D are perspective, top, end and side views, respectively of a guide block incorporating a guide tab of the present invention.
Figure 4B:
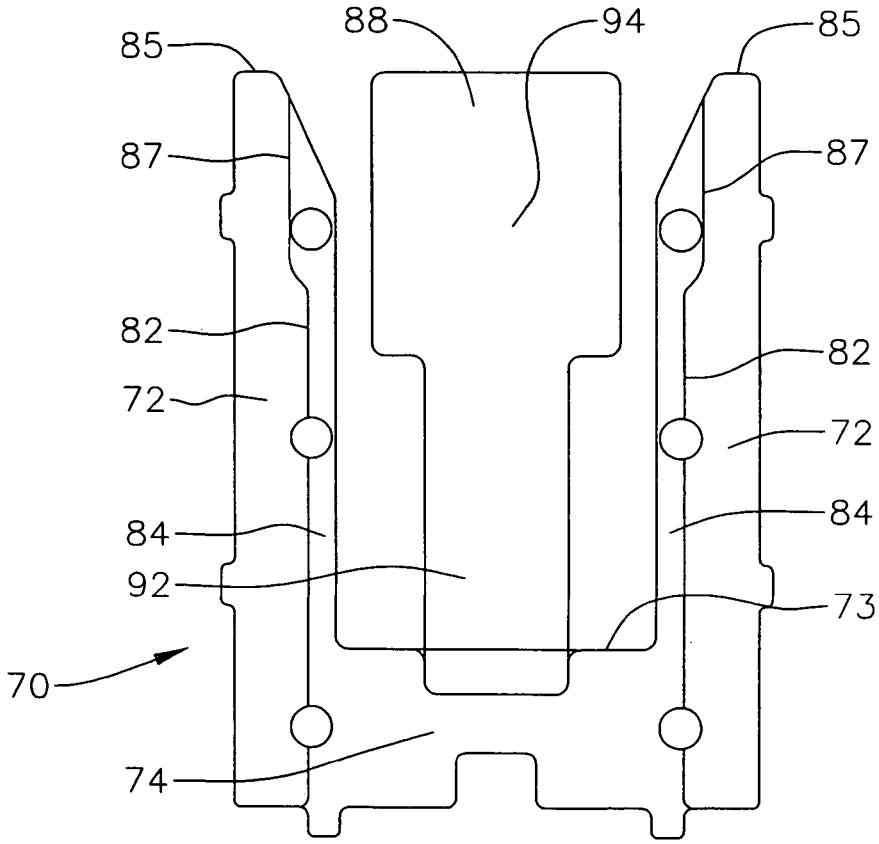
Figure 4C:
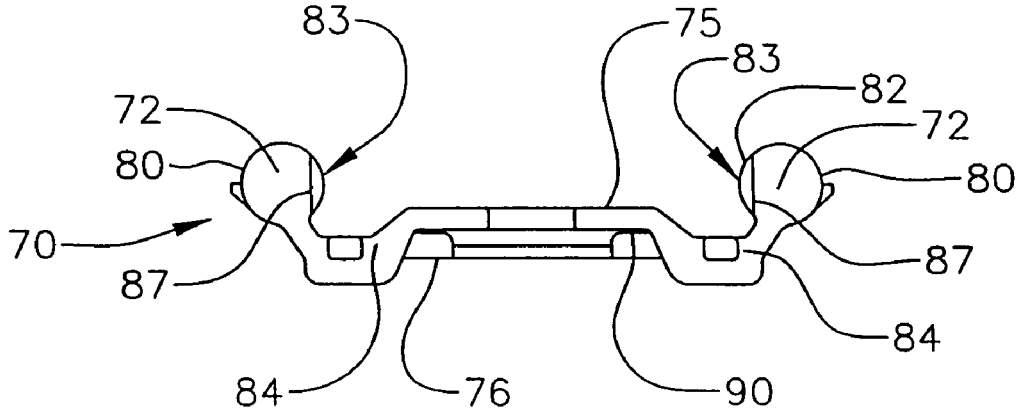
Figure 4D:
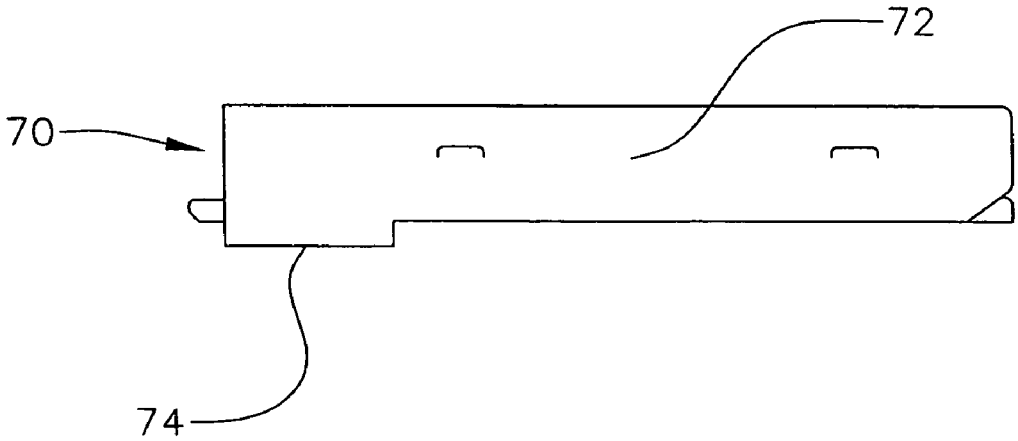

A guide block 70 as for example the guide block shown in FIGS. 4A, 4B, 4C and 4D, is inserted into the raceways of the intermediate member proximate the end 61 of the intermediate member from which the inner member extends, as for example shown in FIGS. 3A and 3B. The guide block comprises two spaced apart legs 72 and a web 74 formed there between such that each leg extends both longitudinally and laterally from the web. In the exemplary embodiment, the guide block web 74 is complementary in cross-section to the web 28 of the intermediate member and a such also defines a depression 76 complementary to the depression 35 defined on the web 28 of the intermediate slide member. An opening 78 is formed transversely across the web 28 of the intermediate member to accommodate the web 74 of the guide block (FIG. 1). As can be seen in FIG. 4D, the web 74 of the guide block extends below the legs 72 of the guide block. In this regard, the web 74 can be accommodated in opening 78 while the legs 72 can be accommodated within the channel of the intermediate member.

Each guide block leg outer surface comprises an outer portion 80 and an inner portion 83. The outer portion 80 of the outer surface of each leg 72 of the guide block is complementary to an inner bearing raceway 32 of the intermediate member. A first section 82 of the outer surface inner portion 83 of each leg opposite the outer portion 80 of each leg is complementary to the outer bearing raceway 42 of the inner member. In the exemplary embodiment shown in FIG. 3B, the complementary section 82 of the inner portion of the outer surface of each leg does not extend to the end 85 of the leg furthest from the guide block web 74. A relatively flat outer surface inner portion second section 87 extends from the first section 82 to the end of each leg 72. In an alternate exemplary embodiment, the complementary or first section 82 of the inner portion of the outer surface of each leg spans the entire length of the leg.

A lip 84 extends inwardly from each leg 72 of the guide block. A surface 86 of each lip faces in the direction of the legs of the guide block and is generally parallel to a first surface 75 of the guide block web 74.

A guide tab 88 extends from the guide block web 74 in the direction of the guide block legs 72. The guide tab 88 extends from a second surface 90 opposite the first surface 75 of the guide block web (FIG. 4C). The width of the tab is such that it can fit within the cut out 60 formed on the intermediate member web. In the exemplary embodiment shown in FIGS. 3B, 4A and 4B, the tab consists of two sections, a first section 92 extending from the web 74 and having a width smaller than the spacing 68 between the first set lance tabs and a second section 94 extending from the first section and having a width greater than the width of the first section and smaller than the spacing 66 between the second set lance tabs.

The exemplary embodiment guide block with guide tab shown in FIGS. 4A, 4B, 4C and 4D, is made of plastic so that it is resilient. For example, the guide block with guide tab may be made from ABS plastic or molded acetal. In this regard, when pushed, the guide tab bends and when released, it returns to its original position. Alternatively, the guide block with guide tab may be made from other materials that provide the tab with the requisite flexibility and resiliency.

Figure 5:
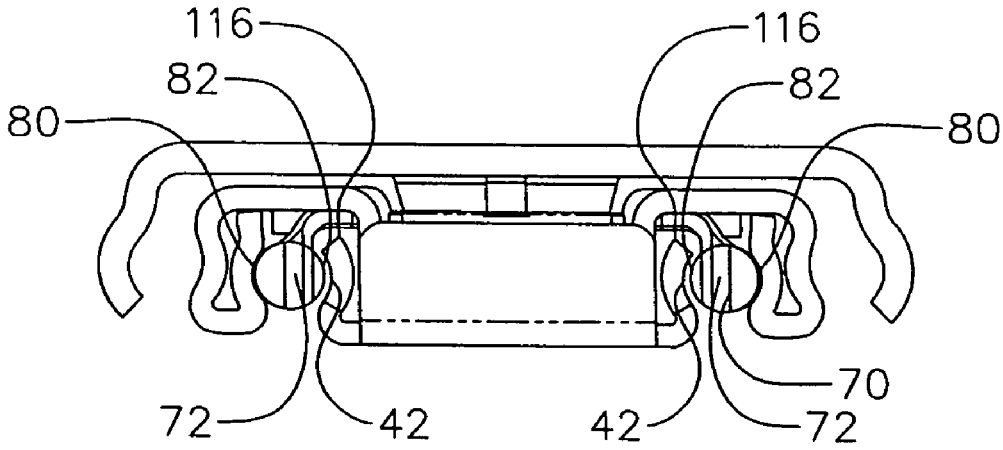
FIG. 5 is an end view of the slide shown in FIG. 1.

The guide block is fitted in the end portion of the intermediate member such that the outer surface portions 80 of the block legs are accommodated by the intermediate member inner bearing raceways while the guide block web is accommodated in the intermediate member web opening 78 and the guide tab 88 extends over the intermediate member web and over the cut out 60, as for example shown in FIGS. 3A, 3B and 5. When the guide block is in position within the intermediate member, the first section 92 of the guide tab is positioned between the first set lance tabs while the second section 94 of the tab is positioned between the second set lance tabs. In this regard, the guide tab can be pushed within the cut out 60 and between the first and second set lance tabs. When mounted on the intermediate member, the guide block lip portion surfaces 86 a level above the web of the intermediate member that is equal or greater in height than the level 87 of the bearing retainer 45 sections 114. (FIG. 2).

To install the guide block with the guide tab on the intermediate member, a tip 115 of the tab is positioned into the opening 78 formed on the depressed web portion of the intermediate member. The guide block is pushed into position causing the guide tab to move through the opening 78 and past the surface of the web 28 of the intermediate member opposite the inner member.

A slot 98 is defined between the inner portion second section 87 of the outer surface of each leg of the guide lock and a second set lance 64. These slots serve to guide the legs of the inner member when reconnecting the inner member to the outer member.

Figure 7A:
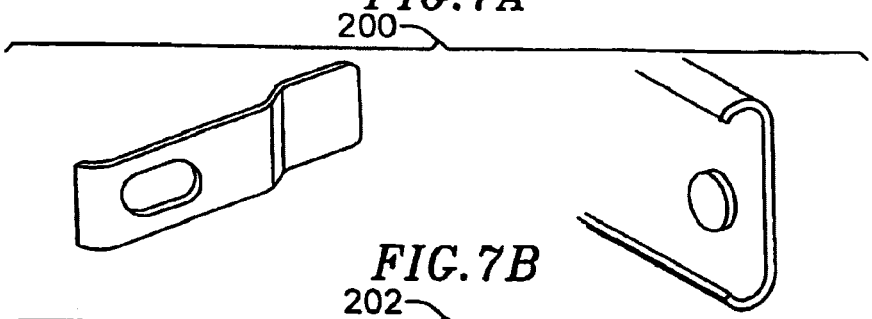
FIG. 7A—7E are perspective views of different latch mechanisms which can be operated by a guide tab of the present invention.
Figure 7B:
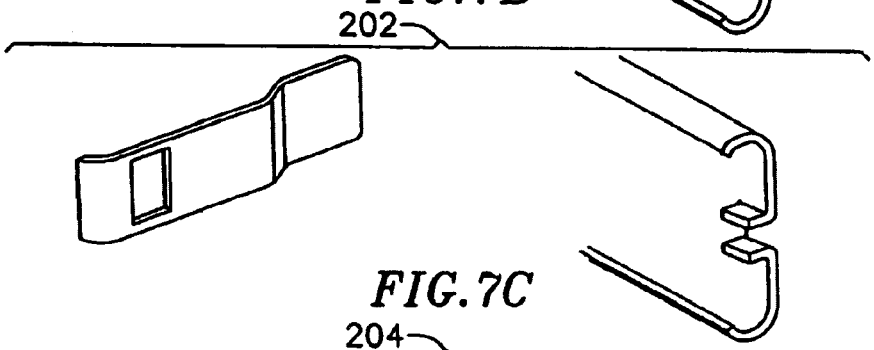
Figure 7C:
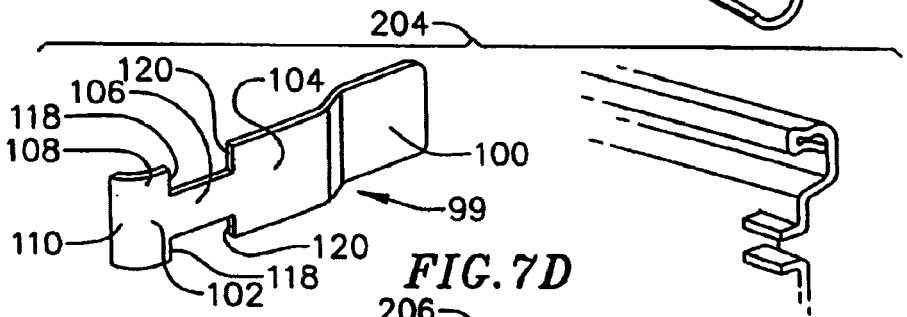
Figure 7D:
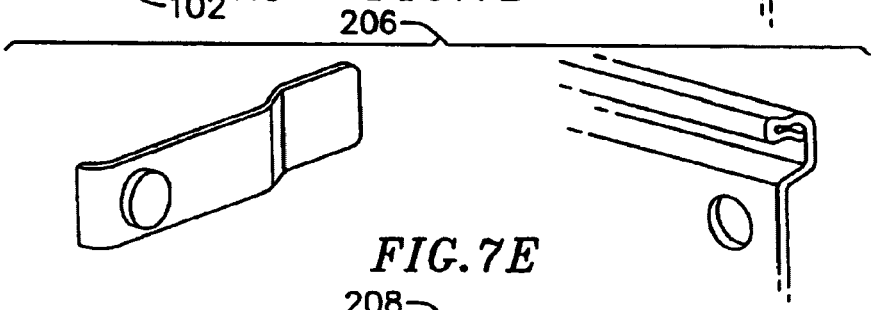
Figure 7E:
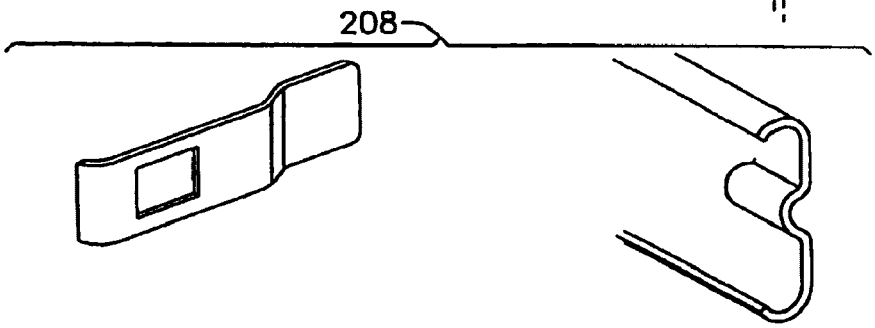
Figure 8A:
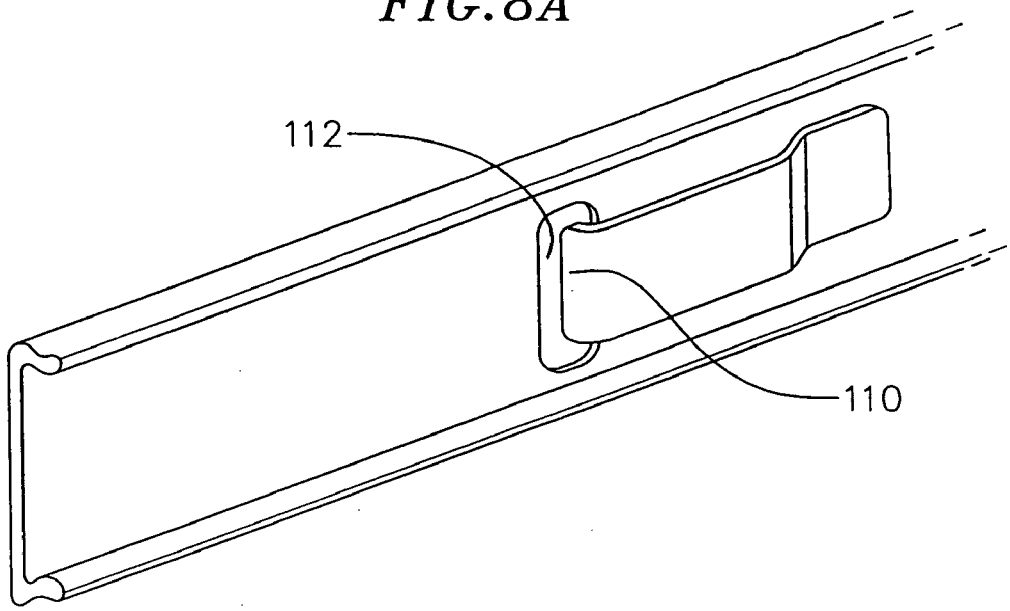
FIG. 8A depicts a perspective view of a lock latch having a bent tip.
Figure 8B:
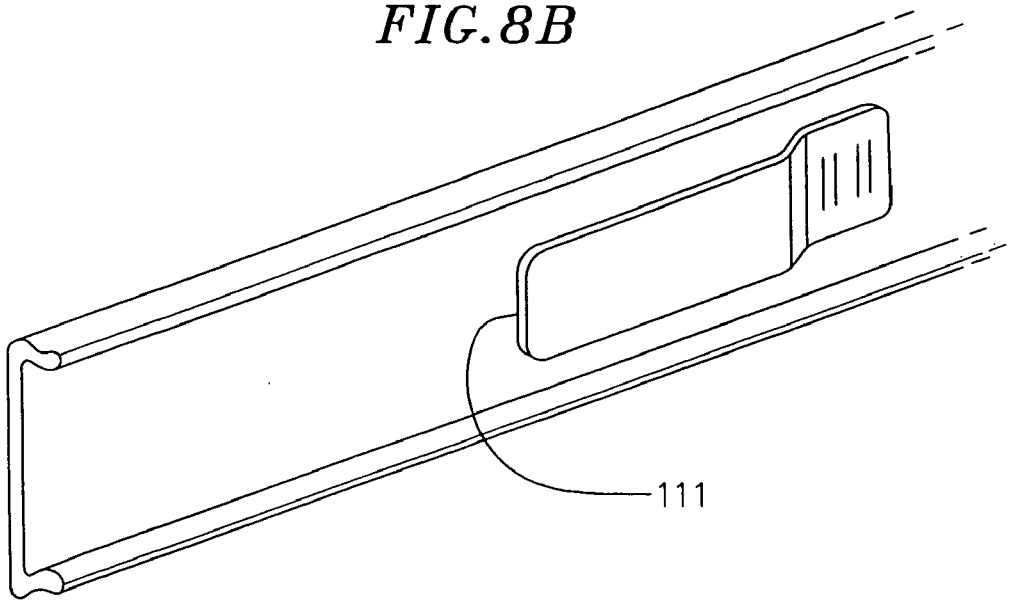
FIG. 8B depicts a perspective view of a lock latch having a flat tip.

A spring tab forming the lock latch 99 (referred to herein as the "latch" for convenience) is attached to the web 38 within the legs 40 of the inner member 12. An exemplary latch as shown in FIG. 7C has a first portion 100 which is attached to the inner member web. A second portion 102 extends for at an angle from the inner member web. The second portion comprises a body portion 104 which narrows to a neck portion 106 which widens to a head portion 108. The neck portion is relatively centered along the width of the body and head portions. The tip end 110 of the head portion is bent toward the web of the inner member and a slot 112 is formed through the web to accommodate the bent tip portion when the latch is pushed against the inner member web, as for example shown in FIG. 8A. In an alternate exemplary embodiment, the tip end 111 of the latch does not have to be bent toward the web of the inner member, i.e., the tip end may be flat as for example shown in FIG. 8B. In such case, slot 112 is not required through the web of the inner member.

To connect the inner member to the intermediate member, the leg portions 40 of the inner member are slid within the slots 98 defined between the guide block legs outer surface inner portion second sections and the second set lance tabs. As the legs of the inner member are pushed further toward the intermediate member the outer bearing raceways 42 formed on the outer surfaces of the legs of the inner member move over the first sections of the inner portions of the guide block legs outer surfaces thereby coupling the inner member to the intermediate member. Simultaneously, edges 116 of the legs of the inner member move over their corresponding lip surfaces 86. As the inner member is further moved in a direction toward the intermediate member, the inner member legs continue to slide along the guide lock legs inner surface and lip surface 86 and are guided to the bearing retainer 45. Because the lip portions of the guide lock legs extend to a level higher than that of the retainer sections 114 in relation to the intermediate member web, the lip portions prevent the legs of the inner member from striking the end edges of the bearing retainer 45.

As the inner member is further pushed in, the latch body is engaged by the first set of lance tabs 62 and pushed toward the inner slide member web until the neck portion moves to a position between the first set of lance tabs. When the latch is pushed toward the inner member web, it generates a spring force urging it away from the inner member web. The spring force causes the latch to extend toward the intermediate member and the neck portion 106 to be straddled between the first set of lance tabs when the neck moves to a position between the first set lance tabs. As the slide is further slid toward the intermediate slide member, the first set lances engage the edges 118 of the head portion of the latch extending beyond the neck portion preventing the slide from sliding further toward the intermediate member. To allow the slide to slide further toward the intermediate member, the head portion of the latch is pushed in by pushing on the guide tab 88 which in turn pushes on the head portion of the latch thereby causing the neck portion to move toward the inner member web and withdraw from the first set lance tabs, allowing the slide inner member to move further toward the intermediate member.

As the inner slide member is extended relative to the intermediate member, the bent tip portion 110 of the head of the latch engages the first set of lance tabs causing the latch to flex toward the web of the inner member and generate a spring force. As the extension of the inner member continues, the first set of lance tabs ride along the head of the latch until they move past the head and straddle the neck portion of the latch as the latch extends due to the generated spring force. As the inner member is further extended, the first set lance tabs engage edges 120 defined on the body portion 104 of the latch adjacent the neck, preventing the inner member from further extending. To allow for further extension, the latch head is pushed toward the inner member web by pushing on the guide tab 88 so as to un-straddle the neck portion of the latch from the first set of lance tabs and allow the latch to move past the first set lance tabs. Consequently, the inner member is allowed to further extend relative to the intermediate member until it disconnects from the intermediate member.

By pushing on the guide tab instead of on the latch with his/her finger, a person does not pinch his/her finger between the intermediate member and inner member during inner member connection to, or disconnection from, the intermediate member, since the tab isolates the person's finger from the interface between the inner and intermediate members.

While in the exemplary embodiment, the guide tab resilience causes it to return to its original position after being pushed for moving the latch, in an alternate exemplary embodiment, the guide tab is not resilient, i.e., the guide tab is made from a material that is non-resilient In such case, the guide tab is returned to its original position by the spring force generated by the depressed or pushed latch.

Figure 6:
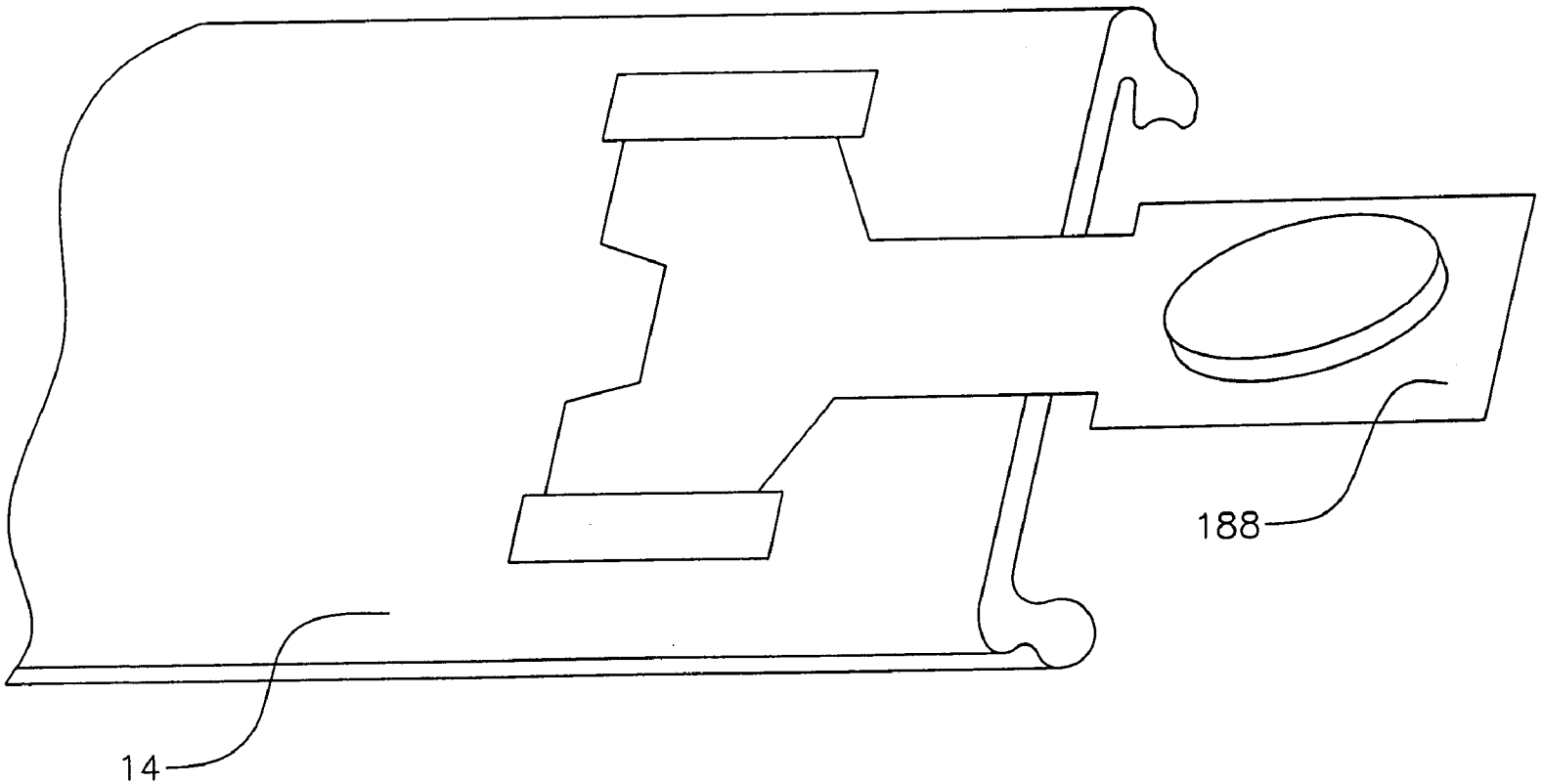
FIG. 6 is a perspective view of an intermediate member of a slide incorporating another exemplary embodiment guide tab of the present invention.

In a further alternate exemplary embodiment, the guide tab may be made to extend beyond the end 61 of the intermediate member from which the inner member will extend, as for example shown by the dashed lines 124 in FIG. 3B. In yet another alternate embodiment, the guide tab may be separate from the guide block. In such case the guide tab 188 may attached to the web of the intermediate member 14 with any many well known methods, as for example shown in FIG. 6.

The guide tab of the present invention has been described for use with an exemplary latch system. However the guide tab of the present invention may be used with other types of latch mechanisms which are used to lock one slide member to another as for example the mechanisms 200, 202, 204, 206 and 208 shown in FIGS. 7A–7E, respectively.

Although the present invention has been described and illustrated to respect to multiple embodiments thereof, it is to be understood that it is not to be so limited, since changes and modifications may be made therein which are within the full intended scope of this invention as hereinafter claimed.

The invention claimed is:

1. A slide comprising:

a first slide member;

a second slide member slidably coupled to the first slide member, wherein the second slide member can extend and retract relative to the first slide member;

a latch coupled to the second slide member allowing the second slide member to couple and decoupled from the first slide member; and a guide tab coupled to the first slide member for moving the latch allowing the second slide member to decouple from the first slide member, wherein the guide tab extends to an end of the first slide member and is moveable through a cutout in the first slide member, said cutout extending to the end of the first slide member.

2. A slide as recited in claim 1 wherein at least a portion of the guide tab extends beyond the end of the first slide member from which the first slide member extends.

3. A slide as recited in claim 1 wherein when the second slide member is extended relative to the first slide member the guide tab extends over the latch, wherein pushing on the guide tab pushes the latch allowing for decoupling of the second slide member from the first slide member.

4. A slide as recited in claim 1 wherein the guide tab is separate from the latch.

5. A slide as recited in claim 1 wherein the guide tab is formed from a resilient material.

6. A slide as recited in claim 5 wherein the guide tab is formed from plastic.

7. A slide comprising:

a first slide member;

a second slide member slidably coupled to the first slide member, wherein the second slide member can extend and retract relative to the first slide member;

a latch coupled to the second slide member allowing the second slide member to couple and decoupled from the first slide member; and a guide tab coupled to the first slide member for moving the latch allowing the second slide member to decouple from the first slide member, wherein when the second slide member is extended relative to the first slide member the guide tab extends over the latch, wherein pushing on the guide tab pushes the latch allowing for decoupling of the second slide member from the first slide member, and wherein the first slide member is an elongated member comprising an elongated web and a leg extending from either side of the web, wherein the web and legs of the first slide member define a channel, the web comprising a cut-out extending to an end of the web from which the second slide member extends, wherein the guide tab extends over said cut-out.

8. A slide as recited in claim 7 wherein the second slide member is an elongated member comprising an elongated web and a leg extending from either side of the web, wherein the web and legs of the second slide member define a channel, wherein the channel of the first slide member faces the channel of the second slide member when the first and second slide member are slidably coupled, wherein when the second slide member is fully extended relative to the first slide member, at least a portion of the latch is positioned within the cutout formed on the web of the first slide member.

9. A slide as recited in claim 8 wherein the guide tab extends from a guide block, the guide block comprising:

a web portion; and two spaced apart leg portions extending transversely from the web portion, wherein the guide tab extends from the web portion between the two leg portions.

10. A slide as recited in claim 9 further comprising an opening formed through the web of the first slide member spaced apart from the cut out, wherein the web portion of the guide block is accommodated in the opening formed thought the first slide member, wherein each leg portion of the guide block is fitted within the first slide member channel adjacent to a leg of the first slide member, and wherein the guide tab extends over the cut out externally from the channel of the first slide member.

11. A slide as recited in claim 10 wherein opposite edges of the guide block web portion are adjacent to and face corresponding edges of the web of the first slide member defining the opening for longitudinally retaining the guide block web portion within the opening.

12. A slide as recited in claim 11 wherein each leg portion of the guide block is located between a leg of the first slide member and a leg of the second slide member.

13. A slide as recited in claim 12 wherein each leg of the first slide member comprises a concave inner surface having a concave cross-section within the channel, and wherein each leg portion of the guide block comprises a convex outer surface having a convex cross-section, wherein each first slide member leg concave inner surface accommodates a guide block leg convex outer surface.

14. A slide a recited in claim 13 wherein each leg of the second slide comprises a concave outer surface having a concave cross-section, and wherein each leg portion of the guide block comprises a convex inner surface having a convex cross-section, wherein when the second slide member slides relative to the first slide member each convex inner surface is accommodated within a corresponding concave outer surface of the second slide member legs.

15. A slide a recited in claim 12 wherein each leg of the second slide comprises a concave outer surface having a concave cross-section, and wherein each leg portion of the guide block comprises a convex inner surface having a convex cross-section, wherein when the second slide member slides relative to the first slide member each convex inner surface is accommodated within a corresponding concave outer surface of the second slide member legs.

16. A slide as recited in claim 15 wherein an end portion of the inner surface of each leg portion of the guide block furthest from the web portion of the guide block is flat.

17. A slide as recited in claim 16 wherein an end portion of the inner surface of each leg portion of the guide block proximate the web portion of the guide block is flat.

18. A slide as recited in claim 17 wherein a lip surface extends transversely from each leg portion of the guide block.

19. A slide as recited in claim 18 further comprising:

a ball bearing retainer having a web and a leg extending transversely from either side of the web; and ball bearings accommodated by each leg of the retainer, wherein the ball bearing retainer is slidably coupled to the first slide member, wherein the ball bearings ride on the concave inner surface of each leg of the first slide member, and wherein the ball bearing retainer web slides over the web of the first slide member, wherein the second slide member leg outer concave surfaces accommodate the ball bearings when the second slide member slides relative to the first slide member and wherein the ball bearing retainer web has a first surface closest to the web of the first slide member and a second surface opposite the first surface.

20. A slide as recited in claim 19 wherein the lip surface of each guide block leg portion extends to a height level as measured from the web of the first slide member that is not lower than a height level of the ball bearing retainer second surface as measured from the web of the first slide member.

21. A slide as recited in claim 20 wherein a central portion of the web of the first slide member is depressed relative to an external surface of the we of the first slide member and protrudes into the channel of the first slide member and wherein a portion of the web portion of the guide block is depressed relative to an external surface of the guide block web portion.

22. A slide as recited in claim 10 wherein a lip surface extends transversely from each leg portion of the guide block.

23. A slide as recited in claim 22 further comprising:

a ball bearing retainer having a web and a leg extending transversely from either side of the web; and ball bearings accommodated by each leg of the retainer, wherein the ball bearing retainer is slidably coupled to the first slide member, wherein the ball bearings ride on the concave inner surface of each leg of the first slide member, and wherein the ball bearing retainer web slides over the web of the first slide member, wherein the second slide member leg outer concave surfaces accommodate the ball bearings when the second slide member slides relative to the first slide member and wherein the ball bearing retainer web has a first surface closest to the web of the first slide member and a second surface opposite the first surface.

24. A slide as recited in claim 23 wherein the lip surface of each guide block leg portion extends to a height level as measured from the web of the first slide member that is not lower than a height level of the ball bearing retainer second surface as measured from the web of the first slide member.

25. A slide as recited in claim 10 wherein a central portion of the web of the first slide member is depressed relative to an external surface of the web of the first slide member and protrudes into the channel of the first slide member and wherein a portion of the web portion of the guide block is depressed relative to an external surface of the guide block web portion.

26. A slide as recited in claim 9 wherein the guide tab flexes relative to the guide block.

27. A slide as recited in claim 9 wherein the guide tab is separate from the latch.

28. A slide as recited in claim 9 wherein the guide tab is formed from a resilient material.

29. A slide as recited in claim 28 wherein the guide tab is formed from plastic.

30. A slide comprising:

a first slide member;

a second slide member slidably coupled to the first slide member, wherein the second slide member can extend and retract relative to the first slide member;

a latch coupled to the second slide member allowing the second slide member to couple and decouple from the first slide member; and a guide tab coupled to the first slide member for moving the latch allowing the second slide member to decouple from the first slide member, wherein the guide tab extends from a guide block, the guide block comprising, a web portion, and two spaced apart leg portions extending transversely from the web portion, wherein the guide tab extends from the web portion, wherein the first slide member comprises a web portion and two leg portions extending from opposite sides of the web portion, and wherein the leg portions of the guide block are mated with the leg portions of the first slide member.

31. A slide as recited in claim 30 wherein the guide tab extends between the two leg portions.

* * * * *

UNITED STATES PATENT AND TRADEMARK OFFICE

CERTIFICATE OF CORRECTION

PATENT NO. : 7,090,319 B2
APPLICATION NO. : 10/222025
DATED : August 15, 2006
INVENTOR(S) : Milligan et al.

It is certified that error appears in the above-identified patent and that said Letters Patent is hereby corrected as shown below:

| | |
|---|---|
| Column 6, line 56, Claim 1 | Delete “decoupled”,<br>Insert --decouple-- |
| Column 7, line 40, Claim 8 | Delete “member”,<br>Insert --members-- |
| Column 7, line 54, Claim 10 | Delete “thought”,<br>Insert --through-- |
| Column 8, line 8, Claim 14 | Delete “a recited”,<br>Insert --as recited-- |
| Column 8, line 16, Claim 15 | Delete “a recited”,<br>Insert --as recited-- |
| Column 8, line 55, Claim 21 | Delete “we”,<br>Insert --web-- |

Signed and Sealed this

Twenty-fourth Day of April, 2007

JON W. DUDAS
*Director of the United States Patent and Trademark Office*